United States Patent [19]

Robinson et al.

[11] 3,990,339

[45] Nov. 9, 1976

[54] ELECTRIC ORGAN AND METHOD OF OPERATION

[75] Inventors: John William Robinson; Stephen L. Howell, both of Jasper, Ind.

[73] Assignee: Kimball International, Inc., Jasper, Ind.

[22] Filed: Oct. 23, 1974

[21] Appl. No.: 517,190

[52] U.S. Cl. ..... 84/1.17; 84/1.03; 84/DIG. 22

[51] Int. Cl.[2] ..... G10H 1/00

[58] Field of Search ..... 84/1.01, 1.03, 1.07, 84/1.11, 1.17, 1.19, 1.24, DIG. 22, 1.26, 1.22

[56] References Cited

UNITED STATES PATENTS

| | | | |
|---|---|---|---|
| 3,544,693 | 12/1970 | Tripp | 84/1.17 X |
| 3,546,355 | 12/1970 | Maynard | 84/1.03 |
| 3,610,799 | 10/1971 | Watson | 84/1.26 X |
| 3,725,560 | 4/1973 | Robinson et al. | 84/1.17 X |
| 3,746,773 | 7/1973 | Uetrecht | 84/1.01 |
| 3,823,246 | 7/1974 | Hebeisen et al. | 84/1.17 |
| 3,839,592 | 10/1974 | Freeman | 84/1.03 X |
| 3,844,192 | 10/1974 | Brand et al. | 84/1.01 |
| 3,871,262 | 3/1975 | Robinson et al. | 84/1.17 |

*Primary Examiner*—Ulysses Weldon
*Attorney, Agent, or Firm*—Melvin A. Crosby

[57] ABSTRACT

An electric organ with logic circuitry incorporated therein which will automatically cause "fill notes" to sound in the solo part of a composition being played with the fill notes being harmonically consistant with the notes being played in the solo part of the composition and with the chords played in the accompaniment part of the composition.

18 Claims, 9 Drawing Figures

ELECTRIC ORGAN AND METHOD OF OPERATION

The present invention relates to electric organs and is particularly concerned with a method of and a system for supplying fill notes to the part of a composition played on the solo keyboard of the organ.

The supplying of fill notes in a composition being rendered on an electric organ can be accomplished manually by a skilled player, but for players of lesser skill, the proper filling in of the solo part of a composition during the playing can be quite difficult. Recently, certain systems have been proposed for developing fill notes of this nature automatically.

The systems referred to depend on switching arrangements and the like which control the routing of signals from a tone generator to the sound system of the organ with the switches being so arranged that fill notes supplied in this manner are harmonically consistant at every instant with keys depressed in the solo keyboard and the chord being played in the accompaniment manual.

The present invention proposes a novel system for developing fill notes in the solo part of an electric organ in which logic circuitry is employed resulting in a relatively inexpensive system with a minimum number of interconnections.

A particular object of the present invention is the application of logic circuitry to the production of fill notes in the solo keyboard so that the fill notes are always harmonically consistant with both the solo and accompaniment parts of a composition being played.

A further object of the present invention is the provision of a system of the nature referred to which can be incorporated in electric organs with a minimum of wiring and utilizing, in the main, substantially conventional logic circuit components.

A still further object of the present invention is the provision of a system of the nature referred to which can readily be constructed from large scale integrated units, thereby effecting considerable economy in respect of construction of the system.

BRIEF SUMMARY OF THE INVENTION

According to the present invention, a system is provided for multiplexing of the solo keyboard of the organ to generate a data stream containing signals corresponding to depressed keys of the solo keyboard in respective time slots and for adding further signals corresponding to "key down" signals to the data stream, also in the respective time slots, said added signals respresenting "fill" notes.

The multiplexing of the solo keyboard, as is known, consists in scanning switches actuated by the keys of the keyboard to generate a data stream and developing signals therein corresponding to the depressed keys of the keyboard in corresponding time slots. This multiplexed data stream is employed through latching circuit means for actuating keyers corresponding to the depressed ones of the keys. The keyers connect terminals of a tone generator with voicing circuit means, amplifier means, and speaker means.

At the same time the solo keyboard is being multiplexed an arrangement is provided for supplying a signal, which, conveniently, is in the form of a five bit binary word, and representing the chord being played in the accompaniment manual. The accompaniment manual is preferably arranged as shown in U.S. Pat. No. 3,708,604 which discloses an organ which can be adjusted to play in a conventional manner or so that a chord is played by the depression of a respective key of a certain group of the accompanying manual keys and which can be referred to as "chord playing" keys.

The solo keyboard is scanned from top to bottom and the key down signals in the data stream are negative going pulses.

In conformity with the negative going key down signals in the data stream from the solo manual, and in further conformity with the five bit word signal from the accompaniment manual, at least one and, preferably, a pair, or even more than a pair, of further negative going signals are supplied to the data stream in time slots thereof which are within an octave range beneath each key down signal in the data stream from the solo keyboard. These added key down signals are inserted in time slots of the data stream in such places that the notes corresponding thereto are harmonically related to the depressed key, or keys, of the solo manual and the chord being played in the accompaniment manual.

The aforementioned five bit work from the accompaniment manual is supplied to a decoder so that, for each five bit word supplied, the decoder supplies an output peculiar to the respective word. Each output from the decoder supplies an enabling signal to a respective one of a group of further decoders. Thus, each five bit word from the accompaniment manual results in the enabling of a single one of the further decoders.

The input sides of the further decoders, and which consist of four input lines each, are connected in parallel to the output of a special circuit which is under the control of the master clock which also controls the multiplexing of the solo keyboard.

The special circuit is so arranged that in response to a clock input of a greater number of counts than that required for scanning the solo keyboard; 64 counts in the case of a 61 key solo manual; the special circuit will supply at the output thereof a series of 12 four bit words repeated 5 times over with one additional word being supplied and whereupon all of the further decoders become ineffective for a period of three counts. Thereafter, the cycle is repeated.

The further decoders referred to have the outputs connected to the input side of a memory bank having stored therein 12 different pairs of four bit words. When the memory bank receives a signal from a decoder of the group of further decoders, one of the pairs of four bit words therein is transferred to the output side of the memory bank.

The output side of the memory bank is connected to the input side of a still further decoder and each pair of four bit outputs from the memory bank corresponds to an output on two wires of the last mentioned decoder. The output wires of the last mentioned decoder develop signals when the decoder is enabled and which enabling occurs in response to the development of a key down signal on the data stream from the solo keyboard.

A latch is supplied from each output wire of the last mentioned decoder and each output signal from the decoder is inserted into the respective latch. Each signal supplied to a latch corresponds to a respective key within an octave range.

The output signals at the output sides of the latches are multiplexed to generate a data stream in which each signal supplied to a latch by the decoders connected thereto appears as a signal in a respective time slot of the data stream which is the same as a key down signal in the data stream from the solo keyboard.

The data stream derived from the latch is supplied to the input of a scanning gate, the other input of which is supplied by the data stream from the solo keyboard. In this manner, a composite data stream is arrived at containing signals in respective time slots corresponding to the depressed keys of the solo keyboard, plus one or more signals for each depressed solo key within an octave therebeneath. The aforementioned signals are operable, through a demultiplexing system, which includes further latch means, to actuate respective keyers or the organ.

In order to prevent a signal in a latch from appearing in every octave along the keyboard, the signals in the latches are erased therefrom after the signal in a latch is first multiplexed and before the same latch is again scanned by the multiplexing means. Since the decoder to which signals are supplied from the memory bank is enabled only in conformity with key down signal developed in the data stream from the solo keyboard, the erasing of the signals in the latches in the aforesaid manner prevents a fill note from being played anywhere except within the octave below the solo key to which it pertains.

The data stream from the solo keyboard which is summed with the data stream from the latch, so as to include the fill note signals added in selected time slots, is supplied, as mentioned, to a demultiplexer which includes a latch, the output side of which is connected to the keyers pertaining to the keys of the solo manual.

An enable-disable circuit is provided, also using the outputs of a six bit counter which is driven by the master clock. This circuit produces pulses on selected, predetermined counts. The pulses are used to enable the supply of added key down signals to the data stream from the solo keyboard at the initiation of a scan thereof and to disable the addition of the key down signals pertaining to fill notes to the solo keyboard data stream at a predetermined point along the keyboard near the lower end thereof. A player operated control may be provided which selects either long or short disable.

For long disable, the second enable-disable circuit will produce a pulse on the count corresponding to the time slot when the solo keyboard multiplexer is scanning the last key in the second to last octave of the keyboard, while for short disable, the second special circuit will produce a disabling pulse prior to the just mentioned long disable pulse.

The circuit is programmed upon installation for the keyboard length, and may also be adjustable by the player for long or short disable. The enable-disable circuit also produces a pulse when the keyboard multiplexer begins a new scan of the keyboard which serves to reenable the addition of key down signals for fill notes to the data stream from the solo keyboard.

In the aforesaid manner, keys played in the lowermost octave of the keyboard do not result in the addition of fill notes, which would be played in the uppermost octave of the keyboard as the system starts a new cycle. The short disable selection, when provided, also allows the player to eliminate the addition of fill notes within the lower region of the solo keyboard at the player's discretion.

The exact nature of the present invention will become more clearly apparent upon reference to the following detailed specification taken in connection with the accompanying drawings in which.

DETAILED DESCRIPTION OF THE INVENTION

Figure 1:
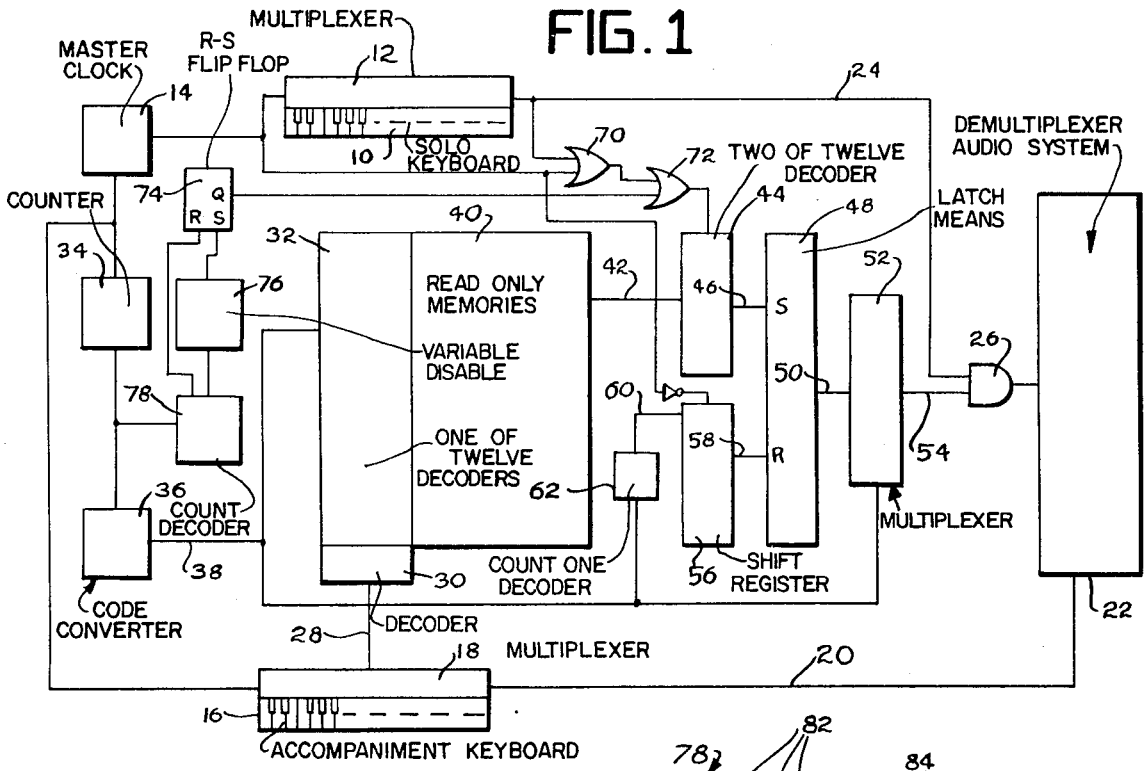
FIG. 1 is a schematic diagram of an organ circuit embodying the present invention.

Referring to the drawings somewhat more in detail, in FIG. 1, reference numeral 10 schematically indicates the solo keyboard of an electronic organ. For the purposes of the present invention, keyboard 10 is assumed to be 61 keys long. It will be understood, however, that the keyboard 10 could be longer or shorter as might be desired.

Immediately adjacent the keyboard 10 is a multiplexing system 12 which is under the control of pulses supplied thereto by a master clock 14. The keyboard 10 is scanned from top to bottom by system 12.

A train of multiplexed signals, or data stream, from the keyboard comprises a series of signals equal in number to the number of keys in the keyboard with first signals in respective time slots in the train corresponding to depressed keys and second signals corresponding to nondepressed keys. The second signals are ineffective for actuating keyers but the first signals, which correspond to the depressed keys, become effective for actuating the keyers.

In the present invention, the said second signals are high and the said first signals are low so that the data stream from the solo keyboard multiplexer stays high until a depressed key is scanned, whereupon a negative going pulse appears in the respective time slot in the data stream.

The master clock supplies pulses at an extremely rapid rate; for example, at the rate of 500 kilohertz and, in this manner, the keyboard 10 is scanned extremely rapidly and there is no perceptible delay between the depression of a key and the production of the corresponding sound from the speakers.

The accompaniment manual keyboard in FIG. 1 is indicated at 16 and there may be associated with keyboard 16 a multiplexing circuit 18 also under the control of master clock 14. The data streams from the solo keyboard multiplexer, and from the accompaniment keyboard multiplexer, when the organ is operating in conventional mode, are both supplied to a system 22 which consists of demultiplexing means, latch means under the control of the demultiplexing means, keyer means under the control of the latch means, voicing circuits, amplifier means and speaker means. These components are all known in the art.

The data stream from component 12 associated with solo keyboard 10 is supplied via a wire 24 to one input of an AND gate 26 which, due to the use of negative logic, functions as an OR gate. The output terminal of gate 26 is connected to the circuitry at 22, while wire 20 conveys the data streams from component 18 of the accompaniment keyboard 16 to the circuitry at 22.

The component 18, or other known circuitry, associated with the accompaniment manual keyboard 16 also supplies five bit binary words to a cable 28 when the organ is adjusted to play in chord mode.

By way of explanation of the two principal modes of operation of the organ, when the organ is adjusted to play in chord mode, the keys of accompaniment manual keyboard 16 are disabled for playing single notes and, instead, a predetermined group thereof are enabled for playing respective chords. An organ circuit showing an organ which can be adjusted from conventional mode to chord mode, and vice versa, is disclosed in U.S. Pat. No. 3,708,604. These last mentioned keys of the accompaniment manual may be referred to as "chord playing" keys and each one thereof, when depressed, causes a respective chord to sound and, also, supplies a respective five bit word to cable 28 Known encoding circuit means can be employed for generating the five bit words.

Cable 28 leads to the input side of a one-of-32 decoder 30. It is assumed for the purposes of the present invention that 31 of the keys of the accompaniment manual are adapted for playing chords and each thereof supplies a respective five bit word to cable 28 when the organ is adjusted for playing in chord mode. When no chord playing keys are depressed, while the organ is adjusted in chord playing mode, then the five bit word on cable 28 is 11111. Each such word supplied to the decoder results in an output at one output terminal of the decoder. The outputs of decoder 30 are connected to enable 31 one-of-12 decoders one at a time. The one-of-12 decoders are schematically illustrated by the box at 32.

Connected to master clock 14 is a counter 34 which counts from zero to 63 repetitively. The count output from counter 34 is supplied to a six wire cable in the form of binary words. This cable leads to the input side of a code converter 36 which receives the count on the six line input cable and repetitively supplies binary counts, or words, zero to 11 five times over, plus a single further count to a four wire output cable 38 and then dwells on a thirteenth binary number for three counts.

It might be pointed out at this time that the binary output on cable 38 is not in conventional sequence, as will be explained hereinafter. The output from code converter 36 is supplied to the addressing inputs of 31 one-of-12 decoders indicated within the rectangle 32.

Connected to the output sides of the 31 one-of-12 decoders are 31 read only memories (ROMs). Each of the read only memories, and which are indicated within the rectangle marked 40, contains twelve eight bit words. The signals, or data, in the read only memories 40 form control signals. When a one-of-12 decoder in rectangle 32 is enable, and the decoder is also addressed, a respective eight bit word from the pertaining read only memory appears at the output side of the read only memory.

The read only memories in rectangle 40, each of which has eight output wires, are connected in parallel and to an eight wire output cable 42 that is connected to the input side of a two-of-12 decoder 44 having a twelve wire output cable 46.

Cable 46 leads to the set terminals of a twelve bit RS latch means 48 and which has a 12 wire output cable 50 leading to a twelve line to one line multiplexer 52. The multiplexer 52 has an output wire 54 on which the data stream is generated and which leads to the other input of the aforementioned negative logic gate 26.

It will be appreciated that latch means 48 form an addressable data storage arrangement, while the read only memories store control signals which are employed to actuate the data storage arrangement.

It will be noted that cable 38 also leads to multiplexer 52 and determines which wire of output cable 50 of latch 48 is effective in respect of inserting a signal in the data stream from multiplexer 52. The effective signals on the data stream from multiplexer 52 are, as in the case of the data stream from multiplexer 12, also negative going.

For a purpose to be explained more fully hereinafter, a shift register 56 is provided having a twelve wire output cable 58 connected in one to one relation to the reset terminals of latches 48. The purpose of shift register 56 is to erase from latches 48 any signals inserted therein after the signals have been multiplexed by the multiplexer 52 and prior to the next sweep of the latches.

Connected to the first position in shift register 56 is a wire 60 leading from the count one decoder 62 which is also supplied by cable 38 from the code converter 36.

The signal supplied by wire 60 to shift register 56 occurs on the second word, or count, of each series of 12 counts from code converter 36.

Returning to wire 24 leading from component 12, this line is high at all times except when a depressed key is encountered during the scanning of keyboard 10. During the scanning of keyboard 10 when a key down is encountered wire 24 goes low. Wire 24 is connected to one input of an OR gate 70 which, due to the use of negative logic operates as an AND gate. The other input of gate 70 is connected to the output side of clock 14.

When a key down signal appears on wire 24, it is initiated at the end of a brief period following the pertaining clock pulse and continues low until about the same brief period has expired after the next rising clock pulse. The output of gate 70 will, thus, go low when the output of clock 14 goes low while wire 24 is also low. In this manner, key down signals on wire 24 are delayed by about ½ clock pulse, thereby allowing the output of the read only memories to assume the correct value prior to the enabling of two-of-12 decoder 44, as described hereinafter.

The output side of gate 70 is connected to the input side of a further gate 72, the output side of which forms the enable line to the previously referred to two-of-12 decoder 44. Gate 72 is an OR gate which, because of the use of negative logic, functions as an AND gate. The other input line of gate 72 leads to the Q output of an RS flip flop 74 which is provided for the purpose of enabling and disabling the two-of-12 decoder 44 below a certain range of the keyboard 10. The keyboard 10, as mentioned, is scanned from top to bottom and, during the scanning of the lower portion thereof, say, the lowermost octave thereof, the flip flop 74 disables the two-of-12 decoder 44 and interrupts the flow of signals to be added to the data stream from the solo keyboard.

As it will be seen hereinafter, this shut-off prevents the system from adding a fill note in an upper octave of the solo manual when a note in the lowermost octave of the solo manual is depressed during operation of the system.

The RS flipflop 74 has the set terminal connected to the output side of a variable disable circuit indicated at 76 and has the reset terminal connected to one terminal of count decoder circuit 78 which is supplied from the six wire output side of six bit counter 34. The count decoder 78, and which is described more in detail hereinafter, supplies a plurality of counts including a pulse at count zero which is supplied to the reset line of RS flipflop 74 to enable gate 72 and a further count which results in the disabling of gate 72 at a predetermined point along the keyboard and which is determined, in part, by the length of the keyboard and, in part, by the choice of the player.

COUNT DECODER

Figure 2:
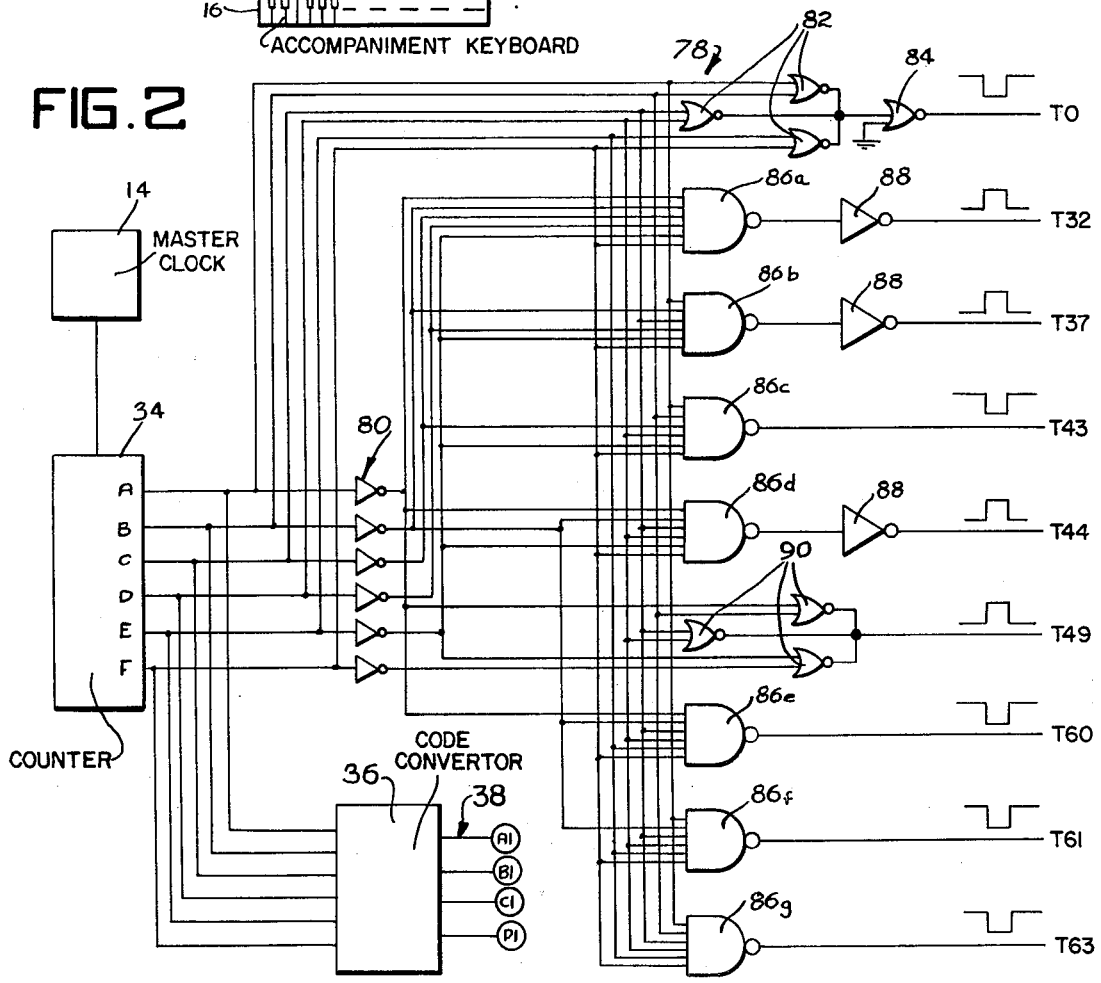
FIG. 2 shows a count decoder for supplying control pulses for control of the circuit of FIG. 1.

The count decoder 78 is illustrated more in detail in FIG. 2. In FIG. 2, the master clock 14 is also illustrated, as well as the six bit counter 34 and the code converter 36.

The six bit counter 34 has six output wires and supplies a conventional binary count in sequence from zero to 63 repetitively. At count zero, all of the output lines from counter 34 are low. Each output wire from counter 34 is connected to the input side of a respective inverter 80. The outputs from counter 34 are also connected in pairs to the input sides of NOR gates 82, the output sides of which are connected together and lead to one input of a NOR gate 84 having the other input grounded. This arrangement provides for a negative pulse at the terminal marked zero on the zero count of counter 34.

The output lines from counter 34 and the output lines from inverters 80 are variously connected as shown to the inputs of the six-input NAND gates indicated at 86*a* through 86*g*. The output sides of NAND gates 86*a*, 86*b* and 86*d* are connected to the input sides of respective inverters 88. The connections to gate 86*a* are such that a positive going pulse appears on count 32 of counter 34 at the terminal marked T32, whereas gate 86*b* is so connected that a positive going pulse appears on count 37 of counter 34 at the terminal marked T37, while the gate marked 86*d* is so connected that a positive going pulse appears at the output terminal marked T44 on count 44 of counter 34.

A further terminal marked T49 receives a positive going pulse on count 49 via a set of NOR gates 90 which are connected as shown and which function in the same manner as the aforementioned NOR gates 82 except that the pulse at terminal T49 is a positive going pulse. The gates 86*c*, 86*e*, 86*f* and 86*g* supply pulses on the respective counts of counter 34 indicated at the pertaining outputs but these pulses are not employed in the circuit illustrated in the present invention. The only pulses supplied from the circuit of FIG. 2 that are employed are those that occur on counts zero, 32 or 37, and 44 or 49 of counter 34.

Also illustrated in FIG. 2 is code converter 36 which, as explained, supplies to its four output wires (cable 38) a series of 12 binary words repeated five times over and then a further single binary word, which is the beginning of the 12 word sequence, and the counter then dwells on a 13th word which is used for a purpose to be described hereinafter. The dwell is for a period of three counts, whereupon the aforementioned repetitive sequence of 12 word groups plus one word commences to repeat.

CODE CONVERTER

Figure 3:
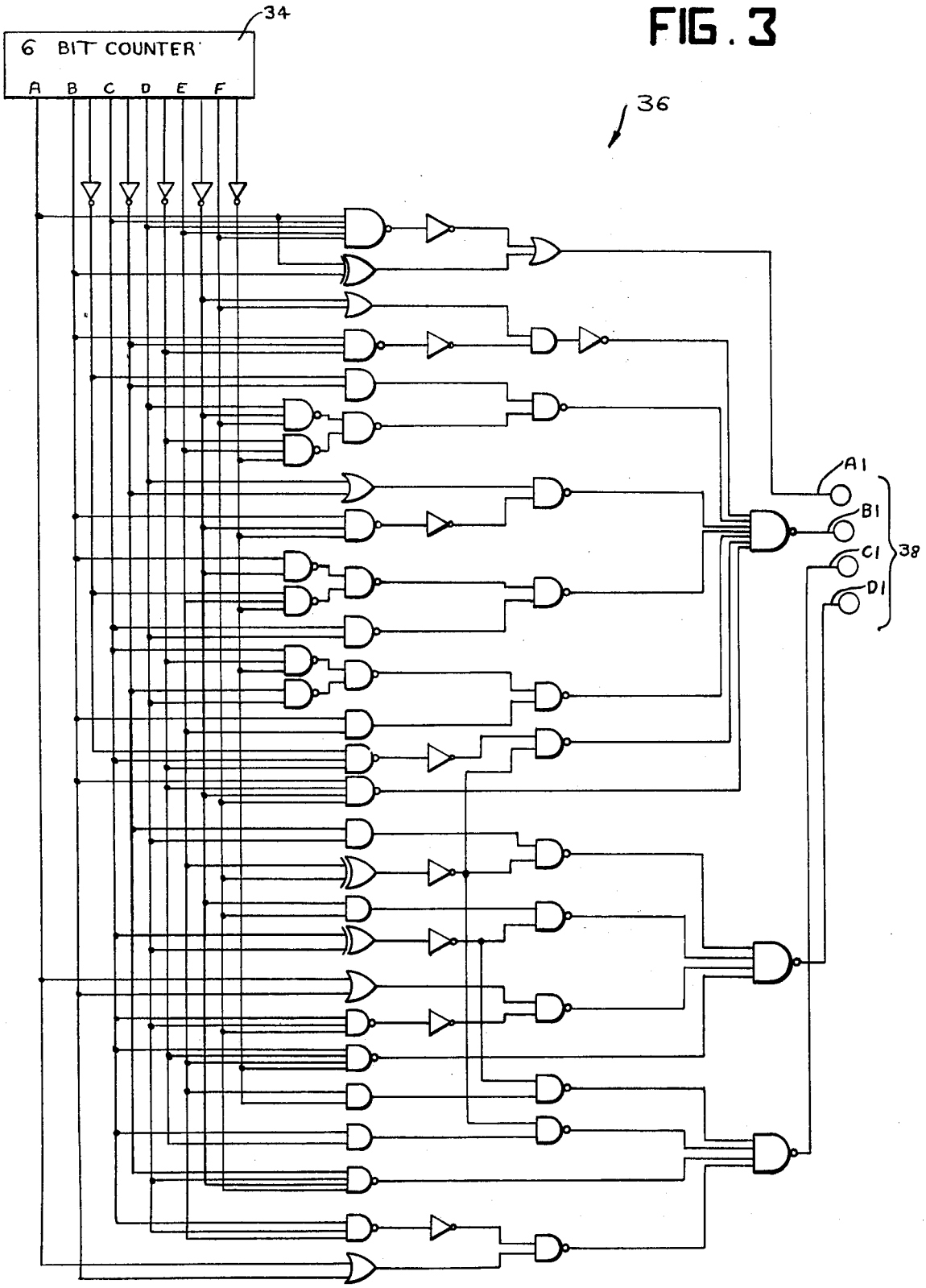
FIG. 3 shows a special code converting circuit for supplying further control pulses or addressing signals according to the present invention.

The code converter indicated at 36 in FIGS. 1 and 2 is shown in considerable detail in FIG. 3. FIG. 3 also shows the six bit counter 34 which supplies code converter 36. The output wires from the six bit counter 34 are designated from A to F in both FIGS. 2 and 3 and each thereof is connected to a source of bias voltage.

The output from code converter 36 appears on the four output lines (cable 38) marked A1, B1, C1 and D1 and consists of binary words but the words do not appear in regular sequence as they do with counter 34. This is accomplished by the series of gates illustrated in FIG. 3. The six bit counter 34 is designed so that the output terminal marked A is the units output and, at the output side of code converter 36, the wire marked A1 is the units output.

Through the use of circuit components which consist of AND gates, NAND gates, OR gates, exclusive OR gates, and inverters, the binary digits supplied by the counter 34 are converted to binary words at output terminals A1, B1, C1 and D1 in conformity with the following schedule:

| COUNTER 34 | OUTPUT OF CODE CONVERTER 36 FOR COUNTS 0 – 63 OF COUNTER 34 | | | |
|---|---|---|---|---|
| | A1 | B1 | C1 | D1 |
| 0 | 0 | 0 | 0 | 0 |
| 1 | 1 | 0 | 0 | 0 |
| 2 | 1 | 1 | 0 | 0 |
| 3 | 0 | 1 | 0 | 0 |
| 4 | 0 | 1 | 1 | 0 |
| 5 | 1 | 1 | 1 | 0 |
| 6 | 1 | 0 | 1 | 0 |
| 7 | 0 | 0 | 1 | 0 |
| 8 | 0 | 0 | 0 | 1 |
| 9 | 1 | 0 | 0 | 1 |
| 10 | 1 | 1 | 0 | 1 |
| 11 | 0 | 1 | 0 | 1 |
| REPEAT FOR COUNTS | 12 – 23 | | | |
| | 24 – 35 | | | |
| | 36 – 47 | | | |
| | 48 – 59 | | | |
| 60 | 0 | 0 | 0 | 0 |
| 61 | 1 | 0 | 1 | 1 |
| 62 | 1 | 0 | 1 | 1 |
| 63 | 1 | 0 | 1 | 1 |

In the schedule it will be noted that while the counts from six bit counter 34 are identified in one column by the arabic numeral equivalents, the output from counter 34 is actually in the form of binary words which occur in order.

What the count decoder 36 accomplishes is the changing of the order in which binary words appear at the outputs thereof. The sequence of the words appearing at the output lines of the code converter 36 will be seen to occur in the following order zero, one, three, two, six, seven, five, four, eight, nine, 11 and 10.

This sequence is repeated five times over and on count 60 the first word of a sequence is developed at the output side of code converter 36 and then on count 61 a 13th word, not appearing previously, is developed and this word is held for counts 62 and 63 and, on count 64, the sequence again commences with the word zero at the output side of the count decoder 36.

Figure 4:
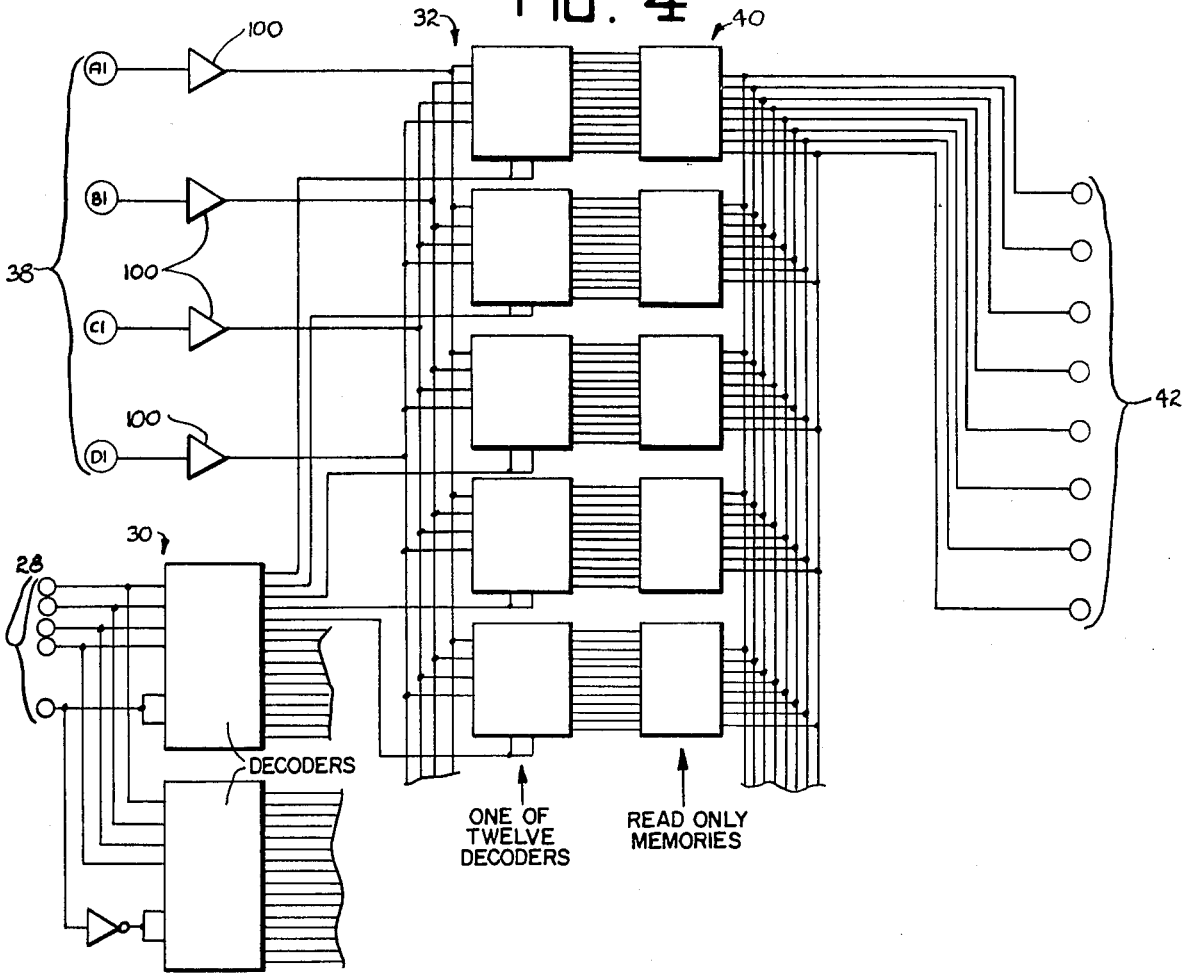
FIG. 4 shows a group of read only memories forming a memory bank which is employed in the circuit according to the present invention.

The outputs from code converter 36 are connected via buffers 100 with the addressing inputs of the one-of-12 decoder 32, as will be seen in FIG. 4.

FIG. 4 also shows that the five bit binary words from the accompaniment manual are connected to the input sides of the aforementioned one-of-32 decoder 30, the outputs from which are connected to the enabling terminals of respective ones of the 32 one-of-12 decoders 32. Only five of the decoders 32 are illustrated in FIG. 4. Each of the decoders 32 has the 12 output wires thereof connected to the input side of a respective read-only memory 40.

From the foregoing, it will be seen that, for each five bit word from the accompaniment keyboard, indicating the playing of a respective chord, a single one of the decoders 32 will be enabled. The inputs of the enabled decoder are continuously addressed by the output from code converter 36 whereby the read only memory connected to the enabled decoder repetitively supplies two four bit words at the output side with the word changing on each address of the respective decoder.

Figure 5:
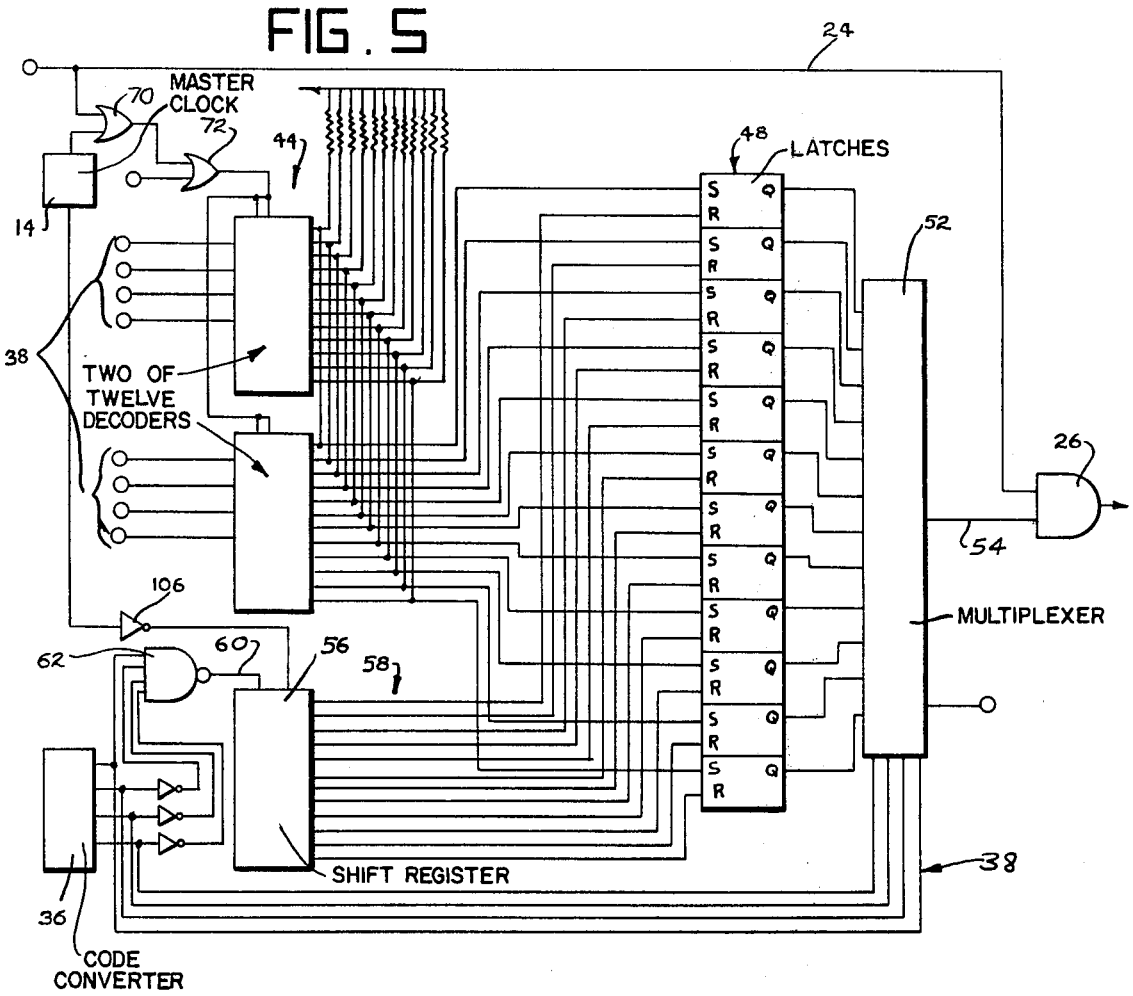
FIG. 5 shows the circuitry following that of FIG. 4 and wherein the signals corresponding to fill notes are added to the data stream from the solo keyboard.

The outputs of the read only memories 40 are connected in parallel, to form eight wire cables 42, and are supplied to the pair of one-of-12 decoders at 44 (FIG. 5). Each four bit word from the read only memories 40 supplies the four inputs of a respective one of the pair of one-of-12 decoders 44 (FIG. 5). Thus, each decoder 44 will develop a signal on one of its 12 output wires for each pair of four bit words supplied by a read only memory.

The corresponding output wires from decoders 44 are connected together, to form cable 46, and to the respective set terminals of a plurality of flipflops forming latch means 48.

The decoders 44 are enabled, via gate 70 only when a key down signal is developed in the data stream from the solo keyboard, and only while gate 72 is also enabled. Thus, the decoders 44 are effective for supplying signals from the outputs thereof to the respective set terminals of the latch means 48 only when a key down signal is developed in the data stream from the solo keyboard.

The outputs from latch means 48 are connected, via cable 50, to multiplexer 52 which is continuously addressed by counter 36 via cable 38 to supply a data stream to wire 54 leading to one terminal of gate 26. The signals from latch means 48, inserted therein from decoder 44, appear on the data stream as negative going pulses and are added in respective time slots to the data stream from the solo keyboard via gate 26.

Latch means 48 also has reset terminals and these are connected to the outputs of a twelve bit shift register 56. Register 56 receives a pulse at one end from a NAND gate 62 which detects a count from code converter 36, namely, the second count in each series of twelve counts supplied by the code converter.

The pulsing terminal of register 56 is connected via inverter 106 with the output side of master clock 14 so the shifting of the pulse supplied to the one end of the shift register is moved therealong with a predetermined delay in respect of the loading of latch means 48. The output from register 56 and which is connected to the reset terminals of latch means 48 thus follows behind the scanning of the latch means by multiplexer 52 whereby a signal in the latch means is erased therefrom after going into the data stream generated by the multiplexer 52 and before the latch means is again scanned.

The clearing, or erasing, of the latch data is important for preventing a fill note from sounding in any octave of the solo keyboard except in the octave immediately below the solo note to which the fill note pertains. In the aforesaid manner, a "window" is established which confines the supply of fill notes to the pertaining octave of the solo keyboard.

Figure 6:
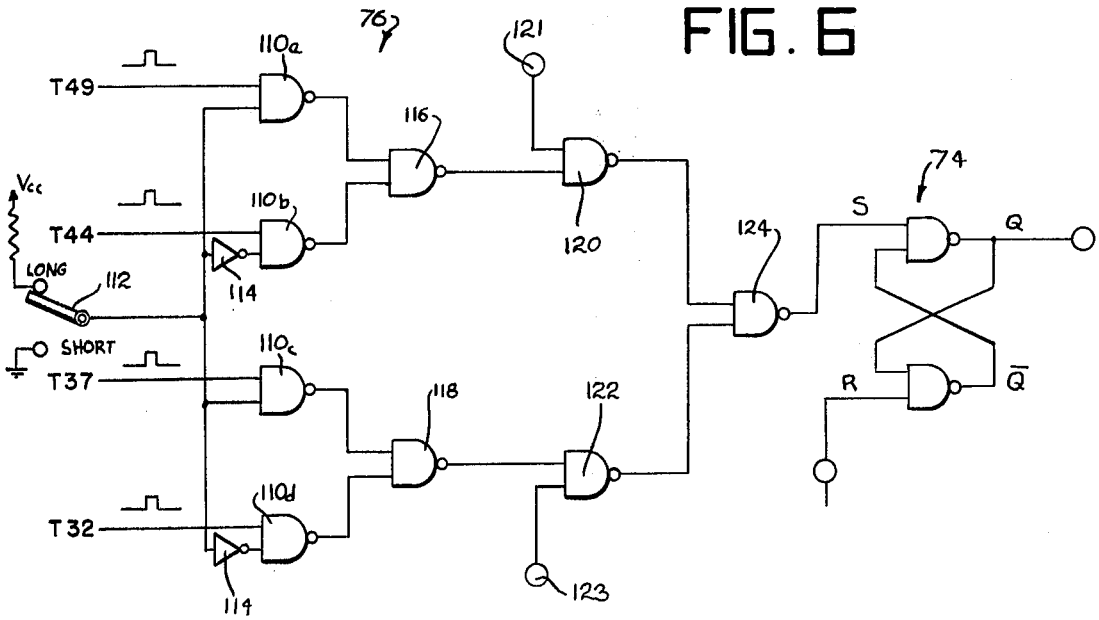
FIG. 6 shows a variable enable-disable circuit forming a part of the present invention.

Turning now to FIG. 6, this view shows the variable disable system of the present invention, and which includes circuit 76 and flipflop 74. Circuit 76 receives pulses from the count decoder 78 on counts 32, 37, 44 and 49 at the terminals so indicated.

In FIG. 6, each of the terminals referred to supplies one input of a respective NAND gate 110*a*, 110*b*, 110*c* and 110*d*, respectively. A switch blade 112 is connected to the other inputs of gates 110*a* and 110*c* and is connected to the other inputs of gates 110*b* and 110*d* via respective inverters 114. Blade 112 can be closed on a ground connection for "short" disable and on a source of plus voltage for "long" disable. The output sides of gates 110*a* and 110*b* are connected to the inputs of a further NAND gate 116 while the output sides of gates 110*c* and 110*d* are connected to the inputs of NAND gate 118.

The output of each of gates 116 and 118 are connected to one input of a still further respective NAND gate 120, 122. The other input of each of gates 120, 122, indicated at 121, 123, respectively, is adapted for being selectively grounded or held high at logic 1.

The outputs of gates 120 and 122 are connected to the input of NAND gate 124, the output of which is connected to the set terminal of flipflop 74.

If the solo keyboard is 61 keys long, then terminal 123 is grounded at manufacture so the output of gate 121 holds high, while terminal 121 is held high during organ operation.

If, now, blade 112 is closed on the ground terminal, the output from gate 110*a* will hold high. The output from gate 110*b* will also hold high until a positive going pulse appears at count 44 from count decoder 78 whereupon the output of gate 110*b* will go low. When the output of gate 110*b* goes low, the output of gate 116, which has been low, will go high.

When the output of gate 116 goes high, the output of gate 120 which has been high will also go low. The low from gate 120, together with the high at the output of gate 122, will cause the output of gate 124 to go high and supply an actuating pulse to the set terminal of flipflop 74 which will result in the disabling of gate 72 and interrupt the supply of fill notes to the solo keyboard data stream until a pulse is supplied to the reset terminal of flipflop 74.

In a similar manner, the disabling of gate 72 can occur on pulse 49 from the count decoder 78 by moving switch blade 112 into contact with a source of logic voltage 1. For a short keyboard, terminal 121 is grounded at manufacture while terminal 123 is held high at logic 1 during organ playing. In the case of a short keyboard, a "short" disable occurs at pulse 32 from the count decoder 78 and a "long" disable occurs at pulse 37.

The reset terminal of flip flop 74 is connected to output wire TO of count decoder 78 to reset the flip flop at the beginning of each keyboard scan.

Figure 7:
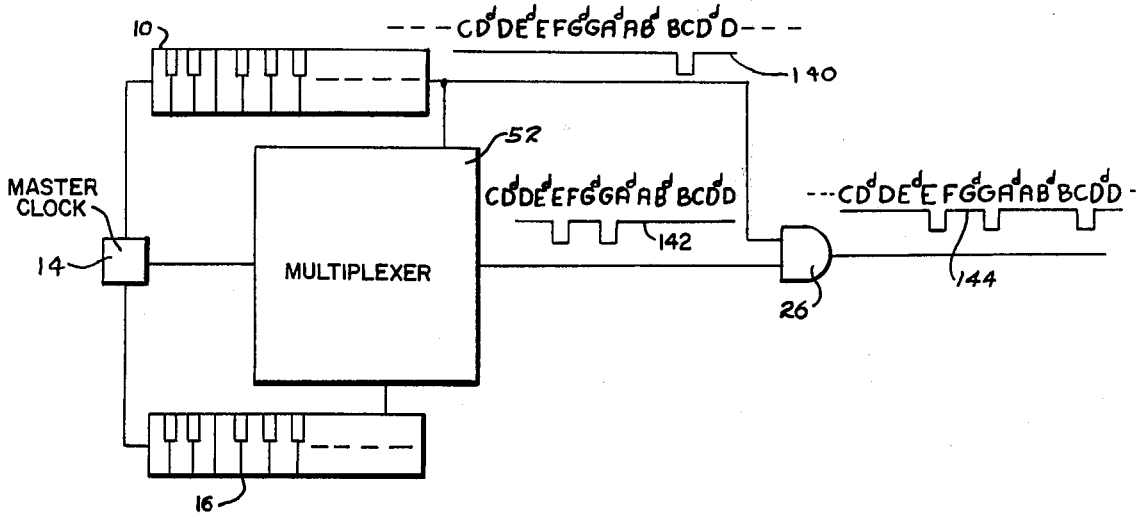
FIG. 7 is a highly diagrammatic view illustrating graphically the manner in which signals are added to the data stream from the solo keyboard in order to provide a fill notes according to the present invention.

FIG. 7 schematically shows the addition of "fill" notes E and G to the solo keyboard data stream when a C chord is played in the accompaniment keyboard and a C note is played in the solo keyboard.

The data stream from the solo keyboard is indicated at 140 and will be seen to have a "key down" signal in only one time slot corresponding to the depressed C key.

The data stream from the multiplexer 52 is indicated at 142 and will be seen to have "key down" signals at E and G.

The data streams are summed via gate 26 and the altered data stream at 144 will be seen to contain the signal for C from the solo keyboard and within the range of an octave therebeneath, the signals for the fill notes E and G have been added. Due to the "window" described in respect of latch 48, the fill note signals appear only once in the altered data stream.

Figure 8:
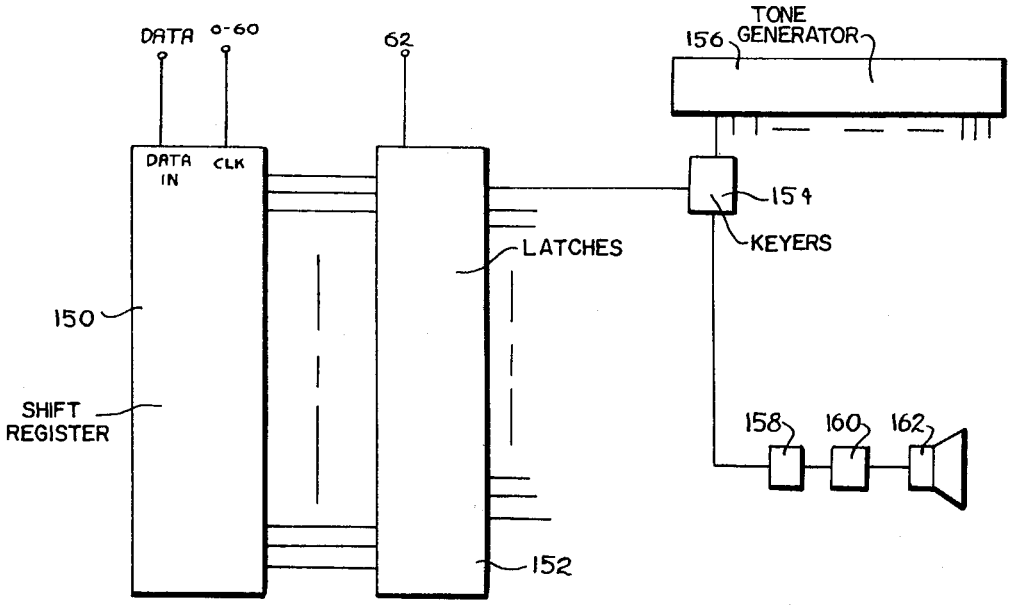
FIG. 8 is a schematic view showing one way in which a data stream can be demultiplexed and utilized for actuating keyers of the organ.

FIG. 8 schematically illustrates how the summed data streams are processed. The summed data stream is supplied to the data input terminal of a shift register 150 and is pulsed therealong by clock pulses from the master clock until, for a 61 note solo keyboard, 61 stations of the shift register hold data. On a subsequent pulse, for example, pulse 62, the data in the shift register 150 is transferred into latch means 152 and latched therein.

The data latched in latch means 152 actuates individual keyers 154 which are interposed between respective terminals of tone generator 156 and the serially arranged voicing circuit means 158, amplifier means 160 and speaker means 162.

Demultiplexing of the accompaniment keyboard can be accomplished in the same manner when the organ is adjusted to conventional mode.

When the organ is adjusted to chord mode, each key of a group of chord playing keys of the accompaniment keyboard actuates a respective group of keyers for notes to form a respective chord while, further, each such key supplies a respective five bit word to the system of the present invention.

Figure 9:
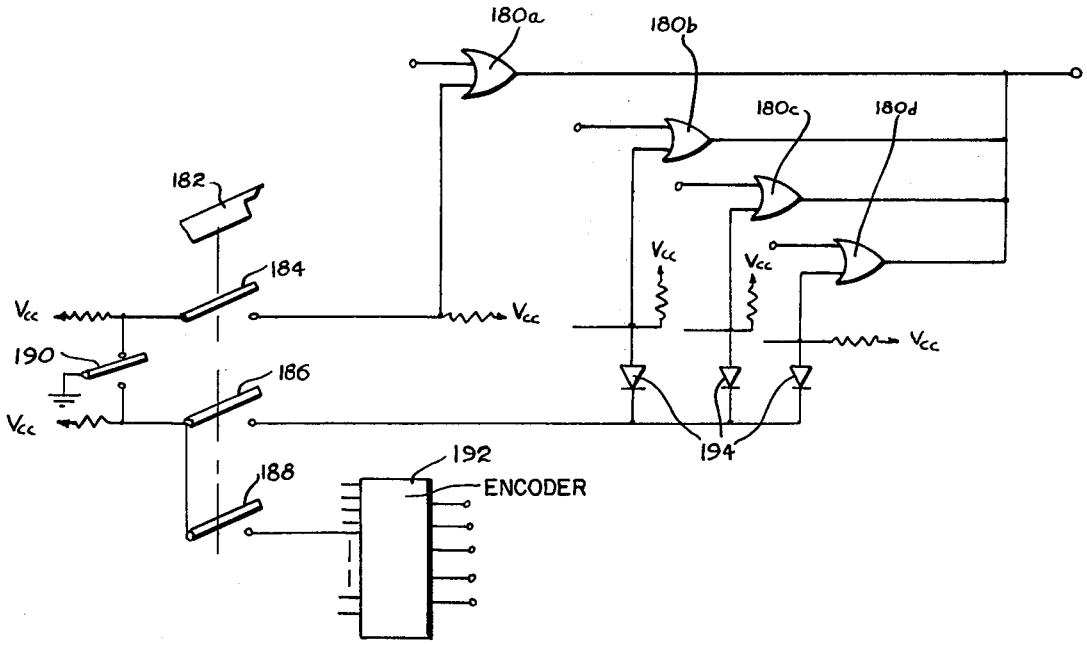
FIG. 9 is a schematic view showing one way in which the accompaniment keyboard of an organ can be adjusted between playing in a conventional mode and playing in a chord mode in which a single key depressed will cause a respective chord to sound.

In FIG. 9, multiplexer 18 is eliminated and the keys of the accompaniment keyboard actuate switches which directly control single keyers or groups of keyers. Those keys which actuate switches which control groups of keyers are the "chord playing" keys and also actuate switches which control an encoder 192 that supplies encoded signals to cable 28. The only difference between FIGS. 1 and 9 is that, in FIG. 9, there is no multiplexing of the accompaniment keyboard.

FIG. 9 shows one way in which an organ can be adjusted from conventional mode to chord playing mode in which multiplexing of the accompaniment keyboard is not desired.

In FIG. 9, keyers 180*a*, 180*b*, 180*c* and 180*d*, which may be OR gates, each has one input terminal connected to a respective terminal of a tone generator and the other input terminal biased high. The output terminals of the keyers are connected to the sound developing system of the organ.

An accompaniment manual key is indicated at 182. Key 182 is one of the group of chord playing keys and each thereof controls switches 184, 186 and 188. A selector switch 190 is adjustable to make switch 184 effective or for making switches 186 and 188 effective.

When switch 190 is in the upper position for conventional mode, switch 184 is effective, and depression of key 182 will cause the single keyer 180*a* to pass tone signals by driving the gate terminal connected to switch 184 low whereupon the tone signals supplied to the other terminal of the gate will be passed through the gate.

When switch 190 is in the lower position for chord mode, switches 186 and 188 are effective, and depression of key 182 will cause keyers 180*b*, 180*c* and 180*d* all to pass tone signals and a respective chord will sound. Also , switch 188 will supply encoder 192 and a respective five bit word will be developed at the output side thereof.

Diodes 194 isolate keyers 180*b*, 180*c* and 180*d* from one another so each can be actuated singly by a respective accompaniment manual key when the organ is adjuted to play in conventional mode.

Modifications may be made within the scope of the appended claims.

What is claimed is:

1. The method of operating an electronic organ having solo and accompaniment keyboards, a tone generator having terminals at respective frequencies, transducer means, and keyers actuatable to connect the terminals of said generator to said transducer means, said method comprising scanning said solo keyboard and generating a first data stream on which key down signals are developed in respective time slots for depressed keys, developing at least one signal of a respective group of control signals in synchronism with the scanning of the solo keyboard for each chord generated in the accompaniment manual, gating the then present control signal to a respective data storage station simultaneously with the development of a key down signal on said first data stream, scanning the storage stations in synchronism with the scanning of the solo keyboard to generate a second data stream in which a stored signal appears as a key down signal in a respective time slot, summing the first and second data streams to obtain a third data stream, and actuating the keyers in conformity with the key down signals in the third data stream.

2. The method according to claim 1 which includes clearing each storage station following the scanning thereof.

3. The method according to claim 1 which includes storing each said series of control signals, selecting a respective said series for each chord played in the accompaniment keyboard, and addressing the control signals of the selected series at the same rate as the keys of the solo keyboard are scanned.

4. The method according to claim 1 in which each control signal develops two further signals simultaneously, and said further signals are gated to respective storage stations simultaneously with the development of a key down signal in said first data stream.

5. The method according to claim 4 which includes selecting said storage stations such that the key down signals on said third data stream are not less than two nor more than eleven time slots away from the respective key down signal in the first data stream and not less than two time slots from each other.

6. The method according to claim 1 which includes actuating a respective group of keyers by the depression of each of at least a predetermined group of the keys of the accompaniment keyboard, and developing a respective series of said control signals for each said key of said group thereof which is depressed.

7. The method according to claim 1 in which said storage station has twelve stations and is scanned once for each octave scanned in the solo keyboard.

8. The method according to claim 1 in which said accompaniment keyboard includes means for generating accompaniment sounds in the form of at least one of single notes and chords.

9. The method of operating an electronic organ having solo and accompaniment keyboards, a tone generator having terminals at respective frequencies, transducer means, and keyers operable when actuated to connect the terminals of said generator to said transducer means, scanning said solo keyboard and generating a first data stream in which signals are developed for depressed keys in respective time slots of the data stream, causing a respective chord to play upon depression of each of a group of keys of the accompaniment keyboard, storing a plurality of control signals, selecting a respective group of said signals for each key of said group of keys which is depressed, presenting said selected signals in succession and at the same rate as the keys of the solo keyboard are scanned, gating the presented signal to a respective storage station simultaneously with the development of a key down signal in said first data stream, scanning said storage stations in synchronism with the scanning of said solo keyboard to generate a second data stream in which a stored signal appears as a second key down signal in a respective time slot, summing the first and second data streams to obtain a third data stream, and actuating the keyers in conformity with the key down signals in the third data stream.

10. The method of operating an electronic organ having solo and accompaniment keyboards, a tone generator having terminals at respective frequencies, transducer means, and keyers actuatable to connect the terminals of said generator to said transducer means, which comprises; scanning the solo keyboard of the organ to generate a data stream in which a depressed key of the keyboard develops a first key down signal in a respective time slot of the data stream, causing at least one note to sound for each key of the accompaniment manual which is depressed, storing a respective group of further signals for each key of the accompaniment manual, presenting selected ones of said further signals in succession and at the same rate as the keys of the solo keyboard are scanned for each key of the accompaniment manual which is depressed, inserting a said further signal as a second key down signal on said data stream in a respective time slot and in timed relation to said first key down signal, and actuating said keyers in conformity with the first and second key down signals.

11. The method of operating an electronic organ having solo and accompaniment keyboards, a tone generator having terminals at respective frequencies, transducer means, and keyers actuatable to connect the terminals of said generator to said transducer means, which comprises; scanning the solo keyboard of the organ to generate a data stream in which depressed keys of the keyboard develop first key down signals in respective time slots of the data stream, causing at least one note to sound for each key of the accompaniment manual which is depressed, storing a respective group of further signals for each key of the accompaniment manual, presenting selected ones of said further signals in succession and at the same rate as the keys of the solo keyboard are scanned for each key of the accompaniment manual which is depressed, inserting said two further signals as second key down signals on said data stream in respective time slots and in timed relation to said first key down signals, and actuating said keyers in conformity with the first and second key down signals.

12. In an electronic organ having solo and accompaniment keyboards, a tone generator, transducer means, and keyers interposed between respective terminals of said tone generator and said transducer means; first means for scanning the keys of said solo keyboard sequentially and operable for generating a first data stream corresponding to said solo keyboard and including means responsive to the depression of a key of said solo keyboard for developing a first key down signal in a respective time slot of said first data stream, second means operable in synchronism with said first means for generating a second data stream, third means responsive to the simultaneous depression of a key of each keyboard for developing at least one second key down signal in a respective time slot of said second data stream fourth means for summing said first and second data streams to generate a third data stream having both of said first and second key down signals in respective time slots thereof, and fifth means for actuating said keyers in conformity with the key down signals of said third data stream.

13. An electronic organ according to claim 12 in which said first means comprises first multiplexing means operable to scan the keys of said solo keyboard in one direction of the keyboard.

14. An electronic organ according to claim 12 in which said second means includes a plurality of latches and second multiplexing means operable to scan said latches sequentially.

15. An electronic organ according to claim 12 in which said second means includes a plurality of latches and second multiplexing means operable to scan said latches sequentially, said third means including control signal storage means and means operated jointly by the depression of a key of each keyboard for supplying at least one signal from said storage means to a respective one of said latches.

16. An electronic organ according to claim 12 in which said third means includes addressable memory bank means and means for addressing said memory bank means in conformity with the respective accompaniment keyboard key which is depressed, said third means also including normally disabled gating means operable when enabled to convey signals from said memory bank means, and means responsive to the development of a key down signal in said first data stream for enabling said gating means.

17. An electronic organ according to claim 16 in which said second means includes a plurality of latches each connected to receive a respective signal from said gating means, and second multiplexing means operable to scan said latches sequentially.

18. An electronic organ according to claim 12 in which said second means includes a plurality of latches and a second multiplexing means operable to scan said latches sequentially, said third means comprising addressable multi-station memory bank means having a plurality of signals stored therein, means for repetitively addressing a predetermined group of the stations of said memory bank means in response to the depressing of a respective accompaniment key, gating means interposed between said memory bank means and the respective latches, and means operated by each first key down signal for enabling said gating means.

* * * * *